United States Patent [19]

Hahn

[11] 4,196,489

[45] Apr. 8, 1980

[54] HAIR BRUSH

[75] Inventor: Rudolf Hahn, Eschborn, Fed. Rep. of Germany

[73] Assignee: Braun AG, Frankfurt am Main, Fed. Rep. of Germany

[21] Appl. No.: 959,003

[22] Filed: Nov. 9, 1978

[30] Foreign Application Priority Data

Nov. 11, 1977 [DE] Fed. Rep. of Germany ..... 2750489

[51] Int. Cl.[2] ..... A46B 9/02; A46B 9/08

[52] U.S. Cl. ..... 15/159 R; 15/168; 132/85

[58] Field of Search ..... 15/159 R, 168–170, 15/186–188, 190–196; 132/9, 11 R, 120, 121, 85

[56] References Cited

U.S. PATENT DOCUMENTS 2,273,717 2/1942 Millard et al. ..... 15/167 R

FOREIGN PATENT DOCUMENTS 2401398 9/1974 Fed. Rep. of Germany ..... 132/85

*Primary Examiner*—Peter Feldman

*Attorney, Agent, or Firm*—Karl F. Ross

[57] ABSTRACT

A hair brush has a convex base formed with grooves at the floor of which are provided recesses in which the bristles are anchored. Between each row of bristles, there is formed a land by ribs upstanding from the floor of the grooves and which prevents loosened hair from accumulating at the base of the bristles.

3 Claims, 4 Drawing Figures

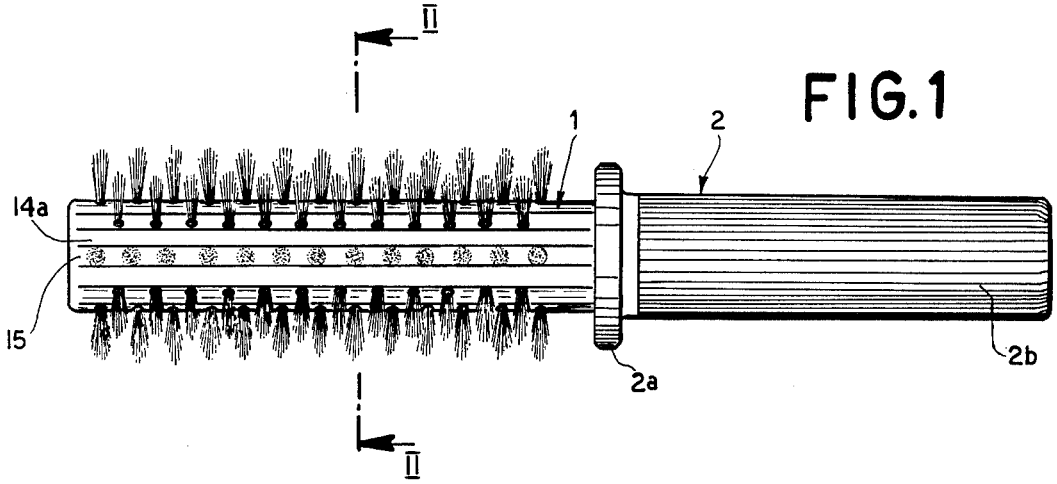
FIG. 1
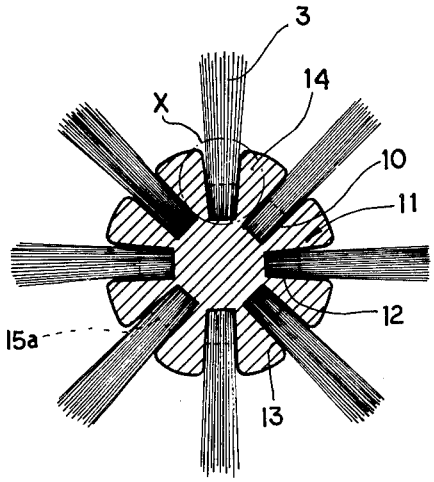
FIG. 2
FIG. 3
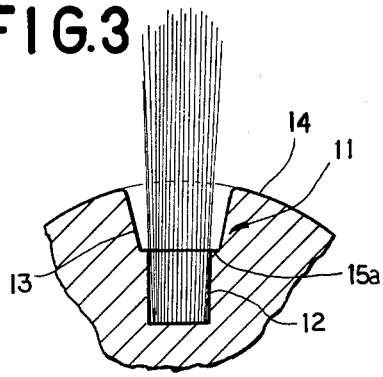
FIG. 4
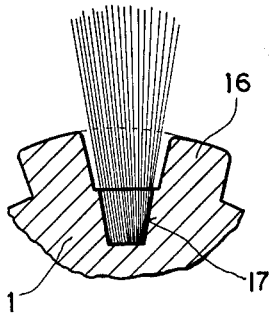

HAIR BRUSH

FIELD OF THE INVENTION

The present invention relates to a hair brush and, more particularly, to a hair brush of the type in which a multiplicity of bunches of bristles are anchored in a support so that the bristles are upstanding from the support and the bunches of bristles, for example, extend in rows generally transverse to the brush action, i.e. the direction in which the brush is moved through the hair.

BACKGROUND OF THE INVENTION

Hair brushes are currently available in a wide variety of forms and the present invention is primarily concerned with the type of hair brush in which a support is provided with a multiplicity of recesses or wells in each of which there is anchored a bunch of bristles of material of synthetic fiber so that the bristles extend generally perpendicular to the surface which is formed with the wells. Ohter type of brushes, e.g. those in which flexible elements are molded unitarily with a base, are not of particular interest for the purposes of the present invention.

Generally the bunches of bristles are anchored by cementing or other means in the respective wells and the wells and bunches of bristles extend in rows which may run parallel to each other and parallel to the longitudinal axis of the brush. The support formed with the wells may be molded from synthetic resin material or fabricated from wood with the wells being produced by drilling. It is particularly convenient to make the face of the support at which the wells open convex so that the brush movement can be a composite of a sweep of the brush through the hair and a rotation of the brush about its longitudinal axis to obtain deep penetration of the bristles and a uniform distribution of hairs over the array of the bristles.

One of the problems with brushes of the latter type, especially where the wells are not completely filled with an adhesive or anchoring medium is that hair gets caught between the walls of the wells or the edge of the latter at which the free ends of the bristles emerge, e.g. by virtue of being clamped between the bristles and this edge. When the bristles are stiff, hair also can be caught between the bristles at the zone of emergence from the well. With further movement of the brush the trapped hairs are pulled loose from the scalp. Another disadvantage is that these regions of the brush afford places in which scalp detritus, dirt and loose hairs can accumulate.

These disadvantages are most prevalent with hair brushes, i.e. where the bristles are relatively stiff. The reason for the increased problem with stiff bristles of hair brushes appears to be a result of the fact that directly upon emergence of the bristles from the well, the bristles are relatively rigid and hairs wedge between them.

OBJECT OF THE INVENTION

It is the principal object of the present invention to provide a hair brush in which this problem is avoided and which is characterized by the ease with which the brush sweeps through the hair, the low tendency to engage hairs and pull them from the scalp, a reduced tendency to collect contaminants and, in general, a significant improvement in all of the properties noted over existing hair brushes.

SUMMARY OF THE INVENTION

These objects and others which will be apparent hereinafter are attained, in accordance with the present invention, in a hair brush which provides a support having a surface at which pluralities of wells or recesses open, bunches of bristles received in each well and emerging therefrom at this surface, a handle if desired to facilitate manipulation of the brush and, in accordance with the essential feature of the invention, lands, ribs or rises positioned above this surface and adjacent the bristles for preventing hairs from being trapped within the bunches of bristles where they emerge from the wells.

In other words, a key feature of the invention is to provide in close proximity to the wells in which the bristles are anchored, support surfaces which are located between the anchorage portions of the wells and the free ends of the bristles to prevent the trapping of hair between the bristles, i.e. surfaces which prevent penetration of the hair downwardly into the region into which the bristles emerge from the well.

I have found that this can be done in various ways. For example, when the bristles are arranged in rows, I can provide an upstanding rib, rising from the surface at which the bristles merge from the wells, between the rows of bristles to serve as the hair-support and penetration-preventions surfaces. This embodiment allows the bores or wells in which the bristles are affixed to be relatively simple.

However, it is also possible to form the bores or wells so that the latter are somewhat deeper than is required for anchoring the bases of the bunches of bristles, in which case the wells can be considered to be those portions which serve for anchorage while the remainder of the bores, in which the bristles move relatively freely, run to the surface of the support which prevents penetration of hairs to the region in which the bristles emerge from the anchoring wells. In this embodiment, the bores or recesses should widen away from, i.e. diverge from, the anchorage wells can be simple cylindrical bores.

In this embodiment, naturally, the outer surface of the brush support forms a support surface for the hair, the support surface, however, being located further above the bases of the bristles. When a circular-section brush is used, i.e. the brush is a so-called round brush, this support will lie radially outwardly of the circle at which the wells terminate. In the outwardly divergent portions of the bores the brushes are freely movable.

Naturally, the outwardly divergent passages need not be bores at all and can, for example, be defined by two walls running the length of the brush and diverging outwardly from the bristle-emergence regions so that the mobility of the bristles increases outwardly as well, i.e. to the free ends of the bristles.

The hair brushes of the present invention can be used effectively for human hair and animal hair with the same advantages. The invention can be used, in general, for all brushes in which the aforedescribed problem may arise.

Naturally, the invention can be employed for all shapes of brushes, e.g. for brushes whose support is prismatic, cylindrical or prismatic-cylindrical hybrid.

Naturally, the invention does not depend upon the material from which the brush is made. Finally, the invention is most effective with relatively stiff bristles because the problem is most pronounced in this case.

BRIEF DESCRIPTION OF THE INVENTION

The above and other objects, features, and advantages of the present invention will become more readily apparent from the following description, reference being made to the accompanying drawing in which:

FIG. 1 is an elevantional view of a round brush according to the invention:

FIG. 2 is a section view along the line II—II of FIG. 1;

FIG. 3 is a detailed view of the region X of FIG. 2; and

FIG. 4 shows still another embodiment of the invention.

SPECIFIC DESCRIPTION

The brush illustrated in the drawing comprises a brush carrier or body of generally cylindrical configuration to which is affixed a generally cylindrical handle 2, the brush body 1 of the handle 2 being separated by outwardly extending flange 2*a* which is molded integrally with the handle and with the body 1. The handle 2 is provided with shallow milled grooves 2*b* to reduce the possibility of slippage.

The support 1 is provided with upstanding ribs 14*a* defining grooves 15 between them, the grooves 15 being molded or drilled to form bores or wells 10 which terminate in the surface 15*a* (FIGS. 1 through 3) the bunches of bristles 3 are clamped or cemented by any conventional technique in the wells. The emergence line of the bunches of bristles is represented at 11 in FIGS. 2 and 3. Below this zone, i.e. over the full depth of the well, the bristles are fixed in the bores 10.

From the emergence location 11, the passages through which the bristles extend (generally represented at 13) flare outwardly, i.e. are divergent, e.g. with conical divergences as shown in FIG. 2 or by being defined between pairs of parallel but outwardly divergent walls.

The walls can merge with the walls of bores or can define a step 15*a* therewith (see FIG. 3) in which the depth of the bore and the height of the rib are in a ratio of 1:1.

When this brush is used to vigorously brush the hair, the hair can only penetrate to the support surface 14 into the bristles. Individual hairs are thus not captured in the bristles or clamped between the bristles or the support since the bristles are highly mobile in the passages 13. This even applies to the relatively stiff bristles of a hair brush.

FIG. 4 shows a brush support in which ribs 16 form the supports between rows of bristles.

The bristles are anchored in wells 17 which can be conical so that the bristles 3 spread laterally outwardly in a tuft-like configuration.

I claim:

1. A hairbrush comprising:

an elongated axially extending body formed with angularly spaced rows of axially spaced outwardly open generally radial wells;

respective bunches of bristles anchored in said wells and emerging therefrom at emergence zones outwardly of which the bristles are deflectable; and respective axially extending ribs between said rows projecting radially outwardly and having flanks limitedly spaced from but lying generally along the bristles, and an outer surface bridging said flanks and of a cylindrical curvature centered on the axis of said body.

2. A hairbrush comprising:

an elongated axially extending body formed with angularly spaced rows of axially spaced outwardly open generally radial wells;

respective bunches of bristles anchored in said wells emerging therefrom at emergence zones outwardly of which the bristles are deflectable; and respective ribs formed on said body between said rows, each of said ribs projecting radially outwardly away from said zones and running axially along said body, said ribs having flanks defining respective steps with the wells of the respective rows and having a radial height in a ratio to the depths of the respective wells of substantially 1:1, and an outer surface bridging said flanks and of a cylindrical curvature centered on the axis of said body.

3. The hairbrush defined in claim 1 or claim 2 wherein said wells are outwardly conically divergent toward said emergence zones.

* * * * *